US005749177A

United States Patent [19]

Pontus et al.

[11] Patent Number: 5,749,177

[45] Date of Patent: May 12, 1998

[54] PISTOL RANGE BACKSTOP

[75] Inventors: John Pontus, Rock Hill, S.C.; Stephen H. Young, Huntsville, Ala.

[73] Assignee: Lockheed Martin Corporation, Bethesda, Md.

[21] Appl. No.: 339,819

[22] Filed: Nov. 15, 1994

(Under 37 CFR 1.47)

[51] Int. Cl.[6] ..... F41J 1/12; E04H 1/00

[52] U.S. Cl. ..... 52/79.1; 273/410

[58] Field of Search ..... 273/410; 52/79.1; 312/107, 198

[56] References Cited

U.S. PATENT DOCUMENTS

| | | | |
|---|---|---|---|
| 2,772,092 | 11/1956 | Nikoden | 273/410 |
| 3,737,165 | 6/1973 | Pencyla | 273/410 |
| 4,512,585 | 4/1985 | Baravaglio | 273/410 |
| 4,598,631 | 7/1986 | Everett | 273/410 X |
| 4,683,688 | 8/1987 | Wojcinski | 52/79.1 |
| 5,040,802 | 8/1991 | Wojcinski et al. | 273/410 |
| 5,086,593 | 2/1992 | Walentine | 312/107 X |
| 5,088,741 | 2/1992 | Simonetti | 273/410 |

FOREIGN PATENT DOCUMENTS

| | | | |
|---|---|---|---|
| 8911076 | 11/1989 | WIPO | 273/410 |

OTHER PUBLICATIONS

*Indoor Range Design Criteria* published by the National Rifle Association (1988.

Polytronic Inc. Brochure, Indoor Shooting Ranges.

*Primary Examiner*—Carl D. Friedman

*Assistant Examiner*—Timothy B. Kang

*Attorney, Agent, or Firm*—Albert T. Keyack; Steven J. Rocci; Stanton D. Weinstein

[57] ABSTRACT

A backstop of the "venetian blind" type and contains a set of angled louvers to deflect projectiles safely. The present invention provides a system of modules whereby a backstop may be constructed across a wall of any width. The backstop modules themselves are made in a number of standardized widths, most preferably about 36 inches (0.91 m), 48 inches (1.22 m), and 60 inches (1.52 m) wide. Using various sets of these modules, any width can be filled in to the nearest foot, i.e., a maximum gap of about six inches remains between the end modules and an adjacent wall surface. These remaining gaps are preferably filled in using a sliding, angled wall plate that accommodates gaps between about zero and six inches. The visible flat edges of plates that form the sides of adjacent modules and the plate against the floor are ricochet hazards, and thus are also preferably provided with angled deflectors. The present invention also discloses an improved angle clip that has a slot that is closed at both ends, an improvement over the open slot clip used in the prior art. Methods of erecting backstops are also provided.

27 Claims, 2 Drawing Sheets

PISTOL RANGE BACKSTOP

The present invention relates to improvements in shooting ranges, and more particularly to backstops for pistol ranges.

BACKGROUND OF THE INVENTION

Pistol range backstops are typically of a configuration known as a "venetian blind" in which a series of slanted plates (lamellas) are arranged in a frame. The "*Indoor Range Design Criteria*", published by the National Rifle Association sets forth the requirements for a venetian blind backstop at ¶3.01.6(1). Bullet traps using this type of design are commercially available from Polytronic, Inc., Switzerland. Ranges of this design have been built and are located in Orlando and Tampa, Fla.

U.S. Pat. No. 4,683,688—Wojcinski discloses a self-contained firing range that includes a backstop that consists of louvered panels of hard rubber material.

U.S. Pat. No. 5,040,802 discloses a backstop that uses a set of replaceable hard rubber lamellas disposed in a frame so that they are readily replaced or repaired.

U.S. Pat. No. 5,088,741—Simonetti discloses a firing range comprised of a number of modules, including a bullet trap or "bullet arresting module" that has a "shutter-bearing" end wall.

However, the construction of these prior art backstops results in a particularly heavy structure since they are constructed of steel, rubber or other dense materials. Additionally, the venetian blind design does not lend itself to being adapted to a particular site, therefore either each backstop is custom made or the site is altered to fill in areas not covered by the backstop, resulting in lost and wasted floor space. It is of course a necessity to cover the entire area toward which the shooters point their weapons. It is further desirable that this area be maximized in a commercial shooting range so that the number of shooters accommodated in a particular space is maximized, either to maximize revenue or to accommodate as many shooters as possible in the instance of a non-profit club or sporting arms organization. Additionally, it would be desirable to provide a backstop design that is easily integrated into nearly any building, and which can be easily transported and assembled.

SUMMARY OF THE INVENTION

One aspect of the present invention is to provide backstops in several standardized widths that can be combined to fill a space of nearly any width. Preferably, widths of 3, 4 and 5 feet are constructed. Any remaining unused space will be less than one foot in width and is filled by filler plates that allow up to six inches of adjustment between backstops and between backstops and a wall.

A second aspect of the invention involves the angle brackets used to connect the plates together. Conventional angle brackets have a U-shaped slot that permits easy assembly, but which also permits the bolt to slide out during the pounding received from the bullets. It has now been found that assembly can still be achieved while using angle brackets that have an elongated hole that is closed across its ends.

DETAILED DESCRIPTION OF THE PREFERRED EMBODIMENTS

Figure 1:
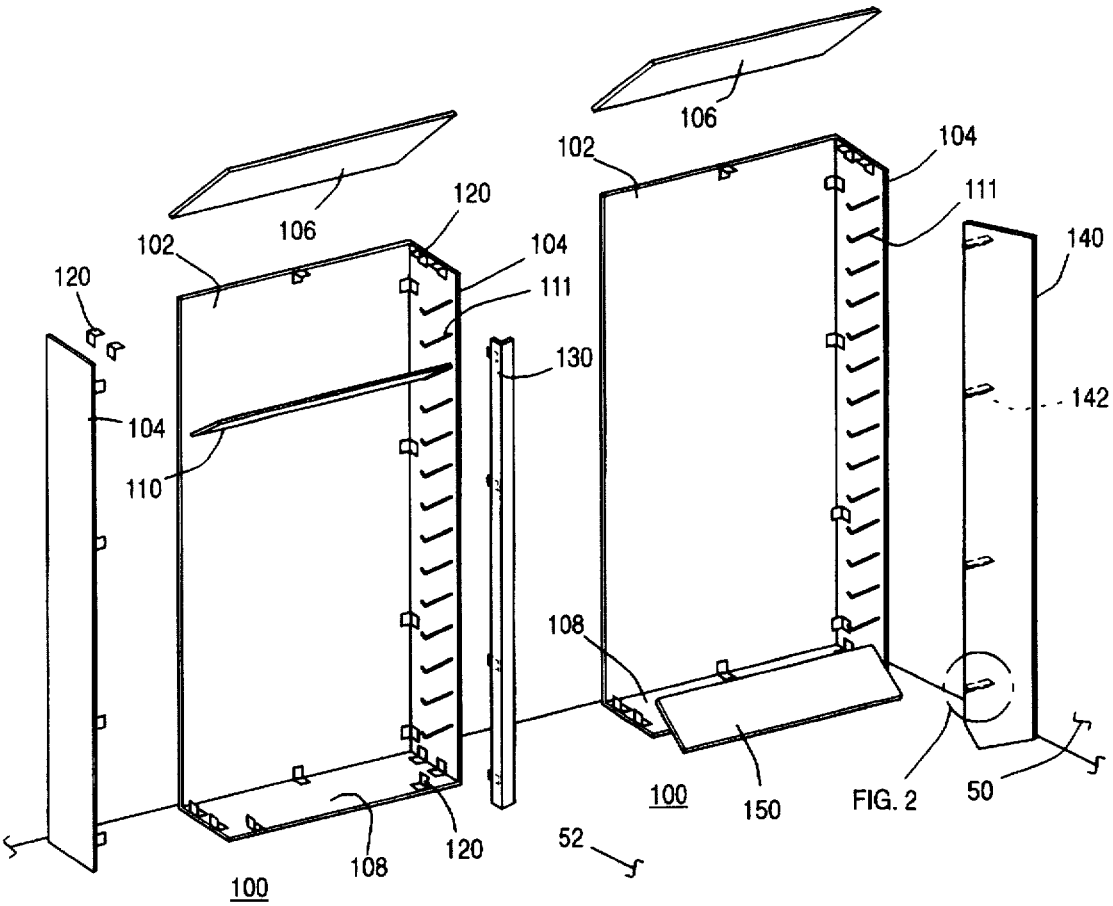
FIG. 1 is an exploded perspective view of two sections of a backstop made in accordance with the present invention.

Referring first to FIG. 1, a perspective view of part of an installation made in accordance with the present invention is shown. Two modules 100 are illustrated; each module 100 is comprised of a back plate 102, side plates 104, a top plate 106, a bottom plate 108 and baffle plates 110. For purposes of illustration, only one baffle plate 110 is shown in FIG. 1; it will be understood, however, that each module 100 will contain a plurality of baffle plates 110. It should be noted that the module in the left side of the illustration is illustrated with two side plates 104, the right side plate being shared with the other module, i.e., this side plate 104 forms the left side of this module. Thus, "right-hand" "left hand" and "center" versions of the side plates 104 are typically required. The thickness of these and all the other plates is selected in accordance with standard practices and specifications known within the art. As explained in further detail below, the modules 100 are preferably constructed in different widths, however, FIG. 1 illustrates two modules 100 of similar width.

Each module 100 is preferably assembled by connecting the plates described above using angle clips 120. As explained in further detail below, the angle clips 120 are most preferably made with closed slots to ensure that the assembly remains secure during the repeated pounding the plates receive when in use. The angle clips, however, are a preferred embodiment of a means for attaching the plates together, and any of the numerous known types of fasteners and techniques for joining metal plates can be substituted. Additionally, one or more of the plates that form the structure that holds the baffle plates could be welded together or the plates could be formed with integral interlocking sections.

After the plates that form the modules 100 are connected, the baffle plates 110 are installed. Each baffle plate 110 rests in an "L" shaped baffle bracket 111 affixed to the side plates 104. The angle at which the baffle plates 110 are held and the shape of the baffle bracket 111 permits the baffle plates 110 to be retained by gravity. However, as discussed above with reference to the angle clips 120, there are numerous ways to attach the baffle plates 110 to the side plates 104 in a manner that permits easy disassembly.

The assembly of the above-described plates and baffle plates 110 creates an individual backstop module 100. However, an installation will typically require more than one module 100. As explained above, the joint between two modules is a shared side plate 104, which presents a thin flat edge toward the shooter and thus creates a ricochet hazard. The center side plate 104, and thus the joint between modules 100 is made safe using an angle iron 130 that is placed so that the point of two diverging sides is presented to the shooter. This ensures that any projectiles that happen to strike on the line between modules 100 are deflected to one side or the other.

Figure 2:
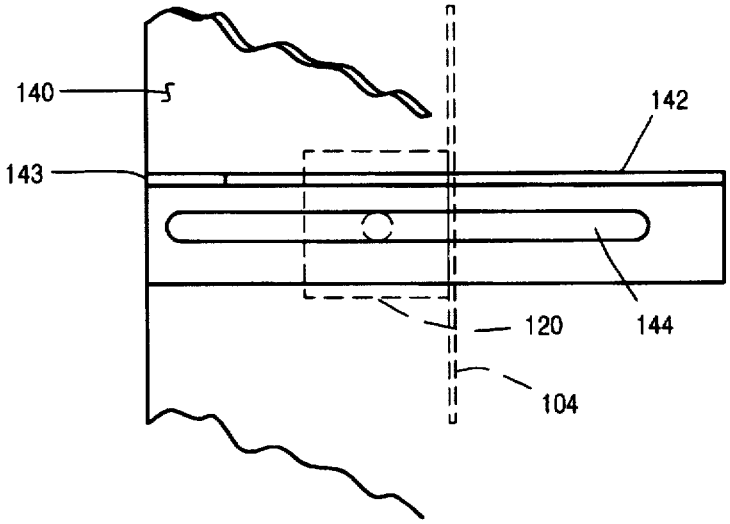
FIG. 2 is an enlarged front elevation view of a preferred embodiment of a sliding bracket used in the modules shown in FIG. 1.

When installed, one of the modules 100 at each end across the width of the assembly will be adjacent a wall 50. This space must be filled in order to ensure that all projectiles strike the backstop, and in accordance with the present invention, a wall plate 140 is provided that is oriented so that the edge nearest the shooter is flush with the surface of the wall and the edge farthest from the shooter overlaps the side plate 104 of the module 100. Most preferably, as illustrated in FIG. 2, the wall plate 140 is attached to the side plate 104 using a sliding bracket 142. The sliding bracket 142 illustrated is most preferably constructed from two inch by two inch, 0.25 inch thick angle iron and is cut at one end to form a mating surface 143 with the side plate 140 such that the angle between the side plate 130 and the wall 50 is about 30°. The sliding bracket 142 is affixed to the side plate 140, preferably by welding, although other forms of attachment can be used.

The sliding bracket 142 permits the distance between the wall 50 and the side plate 104 to vary between approximately zero and approximately six inches. This is preferably accomplished by providing an elongated slot 144 within which the fastener that connects the sliding bracket 142 to an angle clip 120 that is attached to a side plate 104. By providing this degree of tolerance, the overall assembly can cover six inches on either side and thus account for about one foot of width on the overall assembly. Although generally desirable, this feature of the present invention is particularly important to the modular concept described below.

Finally, the front edge of each bottom plate 108 of each module 100 presents a flat edge that is also a ricochet hazard, and must therefore also be covered with a deflecting surface. As shown in FIG. 1, a floor plate 150 is provided that extends toward the shooter and is made to fit flush against the floor 52. The floor plate 150 extends away from the shooter and preferably extends into the interior of the module 100. As the floor plate 150 extends inwardly, away from the shooter, it is elevated from the floor 52, thereby creating a deflecting surface.

Referring now to FIG. 2, further details of the sliding bracket 142 used to affix a wall plate 140 to a module is illustrated.

Figure 3:
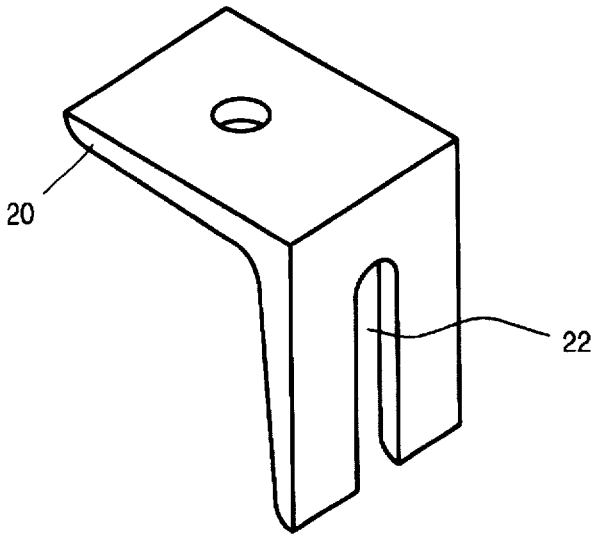
Fig. 3 (Prior Art)
FIG. 3 is a perspective view of a prior art panel clip.
Figure 4:
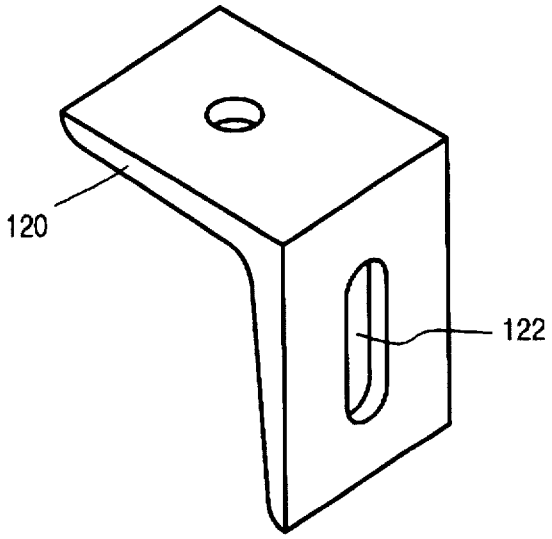
FIG. 4 is a perspective view of a panel clip made in accordance with the present invention.

Another aspect of the present invention is illustrated in FIGS. 3–4. In FIG. 3, a typical prior art angle clip 20 is shown. This clip 20, for joining two plates at a right angle, has a slot 22 that permits adjustments to be made and make assembly of the structure easier. However, a drawback to this type of clip is that the repeated pounding caused by the projectiles that strike the backstop causes the head of the bolt or other fastener that has been passed through the clip 20 to slide along the slot and eventually beyond the slot and the joint thus fails. This phenomenon occurs even though the fasteners are tightened as far as possible and despite the use of lock washers, star washes and the like. It has now been found, however, that a clip 120 such as that illustrated in FIG. 4 can be used in a backstop. The clip 120 made in accordance with the present invention has a elongated slot 122 that is closed at both ends. It has been found that the minor sacrifice of the open end of the clip 20 used in the prior art creates a benefit of ensuring that the clip 122 remains in place and the panels joined by the clip 122 stays intact.

As mentioned briefly above, another important aspect of the present invention is that the modules 100 described above are preferably pre-built in several standardized widths, so that a combination of two or more such modules can fill walls of varying widths. Most preferably, the modules 100 are constructed in widths of three feet (36 inches=0.91 m), four feet (48 inches=1.22 m), and five feet (60 inches=1.52 m). It will be immediately appreciated that when combined with the capability described above to adjust the side plates 140 to cover up to about six inches of space at either end across a width, the present invention can cover a wall of any width greater than about three feet. For example, a wall 11'8" wide is easily covered using two (2) 36-inch modules and one (1) 60 inch module, and the remaining eight inch gap is filled using the adjustable side plates.

Figure 5:
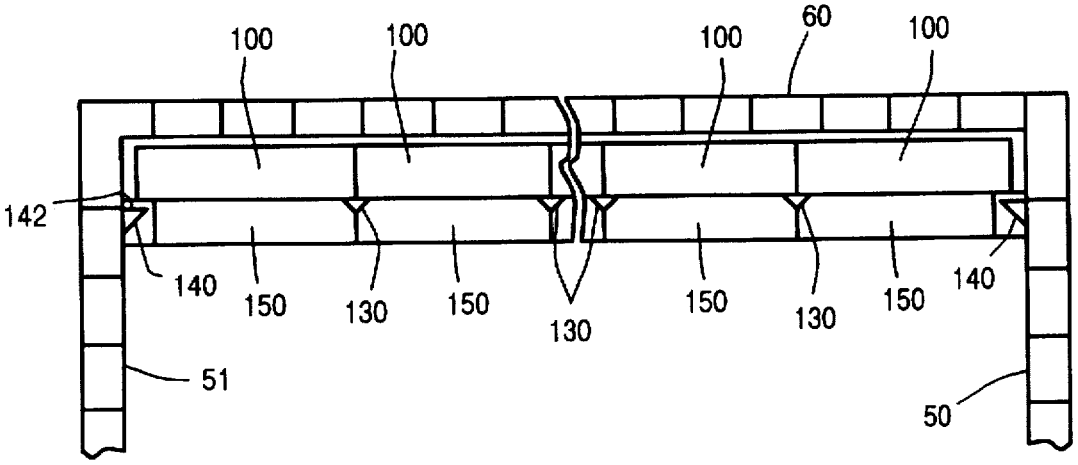
FIG. 5 is a top plan view illustrating a backstop made in accordance with the present invention installed within an interior space.

The modular concept described above is further illustrated in FIG. 5, which is a plan view of a typical installation of the present invention. The room is comprised of side walls 50,51 and a rear wall 60, against which the modules 100 are mounted. In this view, the use of modules 100 of two different widths is shown. The floor plate 150 that is placed in front of each module and an end view of the angle iron 130 are also visible. Near each side wall 50,51, it can be seen that there is a gap between the wall and the adjacent module 100. This gap is covered by the side plates 140, and as discussed above, is most preferably a maximum of six inches. If the gap is greater than six inches adjacent each wall, it is preferable to insert a module that is one foot wider, creating more usable space for the shooters.

The present invention also discloses improvements in methods of installing backstops for shooting ranges. In accordance with the present invention, the width of a wall to receive the backstop is determined, and this dimension is divided into a whole number of standardized intervals, preferably of 36 inches (0.91 m), 48 inches (1.22 m), and 60 inches (1.52 m). Next, sufficient modules having standardized widths equal to the intervals to substantially cover the width are provided. These modules are then installed so that a gap of less than six inches appears between a module and an adjacent side wall. Finally, this gap is covered with a wall plate.

From a review of the foregoing, it will be appreciated that the modular design of the preferred embodiment of the present invention described above represents a significant improvement over the designs of the prior art. Shooting ranges can now be readily constructed from a standardized set of modules, and easily installed in either existing buildings or new construction. Costly customized design and labor-intensive on-site adjustments are virtually eliminated by the present invention.

Although certain embodiments of the present invention have been described above with particularity, these embodiments are meant to illustrate the invention and are not meant to limit its scope. Upon review of the foregoing specification, those of skill in the art will realize many adaptations, modifications and variation of the components described above that utilize the present invention while departing from the specific design illustrated. For example, as noted above, there are numerous ways in which the basic module structure disclosed herein can be varied in terms of its construction. Thus, reference should be made to the appended claims in order to ascertain the full scope of the present invention.

What is claimed is:

1. A shooting range backstop for installation across a structure comprising two side walls defining a width, the backstop comprising:

one or more backstop modules selected from a plurality of standardized width modules of two or more different widths;

a wall plate for covering a gap between a module and a side wall, wherein the wall plate is slidably connected to the module.

2. The shooting range backstop of claim 1, wherein the slidable connection between the wall plate and the module comprises a bracket affixed to the wall plate.

3. The shooting range backstop of claim 1, wherein the two or more different widths are about 36 inches (0.91 m), 48 inches (1.22 m), and 60 inches (1.52 m).

4. The shooting range backstop of claim 3, wherein the wall plate module and covers a gap between the module and the wall of between about zero and about six inches.

5. The shooting range backstop of claim 1, further comprising means covering a joint between a first module adjacent a second module.

6. The shooting range backstop of claim 5, wherein the means for covering is an angle iron that defines two diverging deflecting surfaces.

7. The shooting range backstop of claim 1, wherein the module further comprises a plurality of baffle plates.

8. The shooting range backstop of claim 7, wherein the plurality of baffle plates are affixed to the modules by resting on baffle plate brackets.

9. The shooting range backstop of claim 1, further comprising a floor plate affixed to the module that defines a deflecting surface.

10. A backstop module comprising a back plate, two side plates, a top plate and a bottom plate, and further comprising a plurality of baffle plates affixed to the side plates, wherein the backstop module is a standardized width, wherein the standardized width is chosen from a set of standardized widths, wherein a finite number of modules cooperate to substantially fill a space between two walls, and further comprising a wall plate slidably connected to the backstop module.

11. The backstop module of claim 10, wherein the standardized different widths is chosen from the group consisting of about 36 inches (0.91 m), 48 inches (1.22 m), and 60 inches (1.52 m).

12. The backstop module of claim 10, further comprising a wall plate that is slidably connected to a module that covers a gap between the module and the wall of between about zero and about six inches.

13. The backstop module of claim 10, further comprising a plurality of angle clips for connecting one of: the back plate, the side plates, the top plate and the bottom plate to another plate, wherein each angle clip comprises an elongated hole, closed at both ends.

14. The backstop module of claim 10, further comprising means for covering a joint between a first module adjacent a second module.

15. The backstop module of claim 14, wherein the means for covering is an angle iron that defines two diverging deflecting surfaces.

16. The backstop module of claim 10, wherein the plurality of baffle plates are affixed to the modules by resting on baffle plate brackets.

17. The backstop module of claim 10, further comprising a floor plate affixed to the module that defines a deflecting surface.

18. A method of installing a backstop for a shooting range comprising the steps of:

determining the width of a wall to receive the backstop;

dividing the width into a whole number of intervals of standardized width;

providing sufficient modules having widths equal to the intervals so as to substantially cover the width of the wall;

covering any gap between the modules with a plate that minimizes the possibility of a ricochet;

installing the modules so that a gap of less than six inches appears between a module and an adjacent side wall; and covering the gap with a wall plate that minimizes the possibility of a ricochet.

19. A shooting range backstop for installation across a structure comprising two side walls defining a width, the backstop comprising:

one or more backstop modules selected from a plurality of standardized width modules of two or more different widths;

a wall plate for covering a gap between a module and a side wall disposed at an angle so that it is non-parallel to the side walls, wherein the wall plate is slidably connected to the module.

20. The shooting range backstop of claim 19, wherein the two or more different widths are about 36 inches (0.91 m), 48 inches (1.22 m), and 60 inches (1.52 m).

21. The shooting range backstop of claim 19, further comprising means covering a joint between a first module adjacent a second module.

22. The shooting range backstop of claim 21, wherein the means for covering is an angle iron that defines two diverging deflecting surfaces.

23. The shooting range backstop of claim 19, wherein the module further comprises a plurality of baffle plates.

24. The shooting range backstop of claim 23, wherein the plurality of baffle plates are affixed to the modules by resting on baffle plate brackets.

25. The shooting range backstop of claim 19, further comprising a floor plate affixed to the module that defines a deflecting surface.

26. A backstop module comprising a backplate, two side plates, a top plate, a bottom plate, a plurality of baffle plates affixed to the side plates, a plurality of angle clips for connecting one of the backplate, the side plates, the top plate and the bottom plate to another plate, wherein each angle clip comprises an elongated hole, closed at both ends, and wherein the backstop module is a standardized width, wherein the standardized width is chosen from a set of standardized widths, wherein a finite number of modules cooperate to substantially fill a space between two walls.

27. A backstop module comprising a back plate, two side plates, a top plate, a bottom plate, and a plurality of baffle plates affixed to the side plates, further comprising a wall plate which is slidably connected to a module that covers a gap between the module and the wall of between about zero and about six inches, wherein the backstop module defines a standardized width chosen to cooperate with additional modules to substantially fill a space between two walls.

* * * * *